US006469441B1

(12) United States Patent
Choi

(10) Patent No.: US 6,469,441 B1
(45) Date of Patent: Oct. 22, 2002

(54) PLASMA DISPLAY PANEL HAVING A METALLIC ELECTRODE WITH A WIDER END PORTION

(75) Inventor: Tae-Wan Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/343,045

(22) Filed: Jun. 29, 1999

(51) Int. Cl.[7] ..... H01J 17/49

(52) U.S. Cl. ..... 313/583; 313/582; 313/584; 313/631

(58) Field of Search ..... 313/583, 582, 313/584, 631, 632

(56) References Cited

U.S. PATENT DOCUMENTS 5,359,206 A * 10/1994 Yamamoto et al. ..... 257/59
5,949,502 A * 9/1999 Matsunaga et al. ..... 349/40
6,137,218 A * 10/2000 Kaneko et al. ..... 313/495

FOREIGN PATENT DOCUMENTS

JP 53-020980 2/1978
JP 04056039 A 2/1992
JP 05242810 A 9/1993
JP 06-230749 8/1994

* cited by examiner

*Primary Examiner*—Vip Patel
*Assistant Examiner*—Kevin Quarterman
(74) *Attorney, Agent, or Firm*—Fleshner & Kim, LLP

(57) ABSTRACT

An improved PDP electrode is disclosed. The PDP electrode according to the present invention includes a metallic electrode provided with an end portion width in the non-effective potion of a screen greater than an electrode width in the effective portion, wherein a PDP(Plasma Display Panel) includes a substrate formed of a screen effective portion and non-effective portion, a transparent electrode and metallic electrode arranged in an effective portion of the substrate and each having a certain width in the effective portion, and an electrode having one end extended toward a pad portion of the non-effective portion, for thereby selectively increasing the width of a metallic electrode in a range which does not affect the transmittance, so that it is possible to implement a quick and reliable disconnection and short-circuit checking operation for a metallic electrode which is generally designed to have a minimum line width for a transmittance of a visual ray.

13 Claims, 4 Drawing Sheets

PLASMA DISPLAY PANEL HAVING A METALLIC ELECTRODE WITH A WIDER END PORTION

BACKGROUND OF THE INVENTION

1. Field of the Invention

The present invention relates to a PDP(Plasma Display Panel), and in particular to a structure for a discharge sustaining electrode which makes it possible to generating a surface discharge in a certain discharge space when a discharge voltage is supplied to a display apparatus which uses a plasma.

2. Description of the Background Art

Generally, a PDP(Plasma Display Panel) is a plane display apparatus which is capable of displaying a motion picture or a still picture using a gas charge phenomenon and is classified into a 2-electrode type, a 3-electrode type and a 4-electrode type. The 2-electrode type is directed to applying a voltage for an addressing and sustaining operation using 2 electrodes, and the 3-electrode type is directed to a surface discharge type and is switched or sustained based on a voltage applied to an electrode installed at a lateral surface of a discharge cell.

FIGS. 1 through 4 illustrate a conventional 3-electrode surface discharge type PDP as a representative example.

FIG. 1 is a perspective view illustrating a panel, FIG. 2 is a cross-sectional view illustrating pixels, FIG. 3 is a view illustrating an electrode, and FIG. 4 is a view illustrating a state for checking a short circuit of a discharge sustaining electrode. FIG. 2 illustrates a state that an upper substrate is rotated at an angle of 90°.

The 3-electrode surface discharge type PDP includes a front substrate 1 which is a display surface of an image formed of an effective portion 1*a* and a non-effective portion 1*b*, and a back substrate 2 installed parallely to the front substrate 1 at a certain distance therebetween.

In the front surface 1, a plurality of a pair of discharge sustaining electrodes 6 are parallely crossing the effective portion 1*a* at each pixel for sustaining a light emitting phenomenon of the cells based on a discharging operation. Each sustaining electrode is formed of a transparent electrode 6*a* made of a glass material for preventing a decrease of an aperture ratio, and a metallic electrode 6*b* which is formed along one side of the transparent electrode 6*a* and decreases the resistance. In addition, there are further provided a dielectric layer 7 for limiting a discharging current of two electrodes and insulating the electrodes, and a protection layer 8 formed on the dielectric layer 7.

The back substrate 2 includes a partitioning wall 3 for forming a plurality of discharge spaces, namely, separating the cells, a plurality of address electrodes 4 for performing an address discharge and generating a vacuum violet ray at a portion where the address electrodes 4 cross with the discharge sustaining electrodes 6 on the front substrate 1, and a luminescent material 5 which emits a visual ray for displaying an image during the address discharge.

The light emitting operation of a certain pixel in the conventional PDP will be explained with reference to the accompanying drawing.

First, when a discharge start voltage is supplied between two discharge sustaining electrodes 6 which are provided in pair form at a certain cell, a surface discharge is generated between two electrodes, so that wall electric potentials are formed on the inner surface of a certain discharge space.

When an address discharge voltage is supplied to one of two discharge sustaining electrodes 6 and a corresponding address electrode 4, a writing discharge occurs in the interior of the cell. Thereafter, when a sustaining discharge voltage is supplied to two discharge sustaining electrodes 6 of a corresponding cell, a sustaining discharge occurs between the discharge sustaining electrodes 6 due to the electric potential particles generated during an address discharge with the address electrode 4, so that a light emitting operation of the cells is performed for a certain period.

Namely, an electric field is generated in the interior of the cells by a discharge between the electrodes, and a small amount of electrons of the discharge gas is accelerated, and the accelerated electrodes collide with a neutron particle. The particles are ionized into electrons and ions, so that the discharge gas is changed to a plasma state, and a vacuum violet ray is generated. The thusly generated violet ray excites the luminescent material 5 for thereby generating a visual ray, and the thusly generated visual ray is emitted to the outside through the effective portion 1*a* of the front substrate 1, so that a certain cell is light-emitted, and an image display is implemented.

When fabricating the PDP, in the sustaining electrode 6 formed of the transparent electrode 6*a* and the metallic electrode 6*b*, the metallic electrode 6*b* is easily damaged by a foreign substance generated during the fabrication process or an external impact, and a short circuit by which a certain conduction is made with another neighboring electrode may occur. In a state that the electrode is disconnected or short-circuited, if the PDP is fabricated, an erroneous discharge may occur between the electrodes.

In order to prevent the disconnection and short circuit problems, the disconnection and short-circuit checking operations are performed after forming an electrode pattern. As shown in FIG. 4, a power supplied pad portion 1*c* formed at the non-effective portion 1*b* of the metallic electrode 6*b* and another end portion of the, namely, a checking probe 10 are connected for thereby checking a disconnection and short circuit problem. As another method, both ends of the metallic electrode 6*b* are contacted with the probe 10 for thereby performing a checking operation.

However, in the conventional discharge sustaining electrode 6, in the case of the metallic electrode 6*b* made of a non-transparent material, in order to minimize the decrease of the transmittance of the visual light through the front substrate 1 during a discharge between the electrodes, a certain width "d" is maintained. When using a 60-pin short circuit checking unit, it is impossible to accurately contact the probe with the metallic electrode 6*b* during an automated process. In this case, if the contact state of the entire electrode lines and the checking probe is not checked, it is impossible to implement an accurate checking operation.

SUMMARY OF THE INVENTION

Accordingly, it is an object of the present invention to provide a PDP electrode which makes it possible to selectively increase the width of a metallic electrode in a range which does not affect the transmittance, so that it is possible to implement a quick and reliable disconnection and short-circuit checking operation for a metallic electrode which is generally designed to have a minimum line width for a transmittance of a visual ray, whereby it is possible to implement a stable disconnection and short-circuit checking operation for the electrodes.

To achieve the above objects, there is provided a PDP electrode having a metallic electrode provided with an end portion width in the non-effective portion of the screen greater than the electrode width in the effective portion, wherein a PDP(Plasma Display Panel) includes a substrate formed of a screen effective portion and non-effective portion, an electrode consists of transparent electrode and metallic electrode having a certain width in the effective portion, and each electrode has one end extended toward the non-effective pad portion.

One end of the metallic electrode having a greater width is positioned at another end of the pad portion.

The width of the metallic electrode in the screen non-effective portion is the same as or smaller than the width of the transparent electrode.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The embodiments of the present invention will be explained with reference to the accompanying drawings.

The same electrode construction as the conventional art will be omitted.

Figure 5:
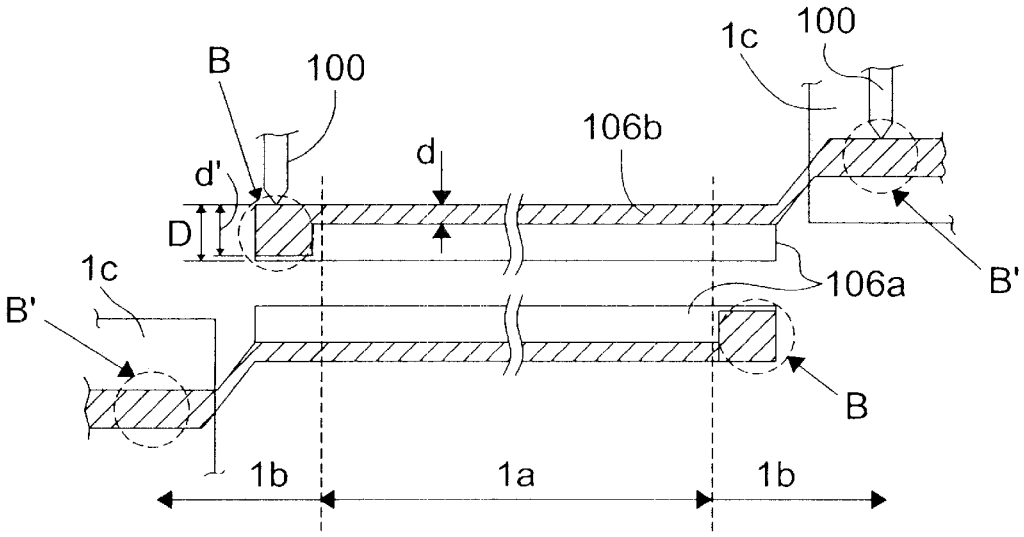
FIG. 5 is a view illustrating a short circuit checking operation for a discharge sustaining electrode according to a first embodiment of the present invention.
Figure 6:
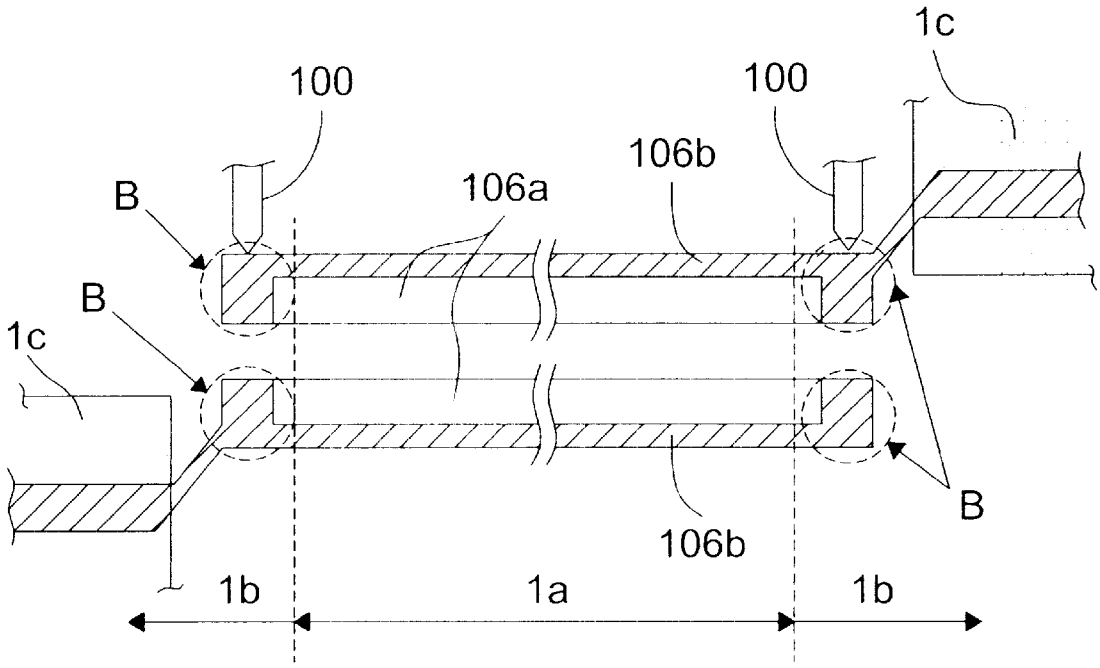
FIG. 6 is a view illustrating a short circuit checking operation for a discharge electrode according to a second embodiment of the present invention.

FIG. 5 illustrates a discharge sustaining electrode according to a first embodiment of the present invention, and FIG. 6 illustrates a discharge sustaining electrode according to a second embodiment of the present invention.

As shown therein, a metallic electrode 106*b* forms a discharge sustaining electrode and has an electrode width "d" along a lateral side of a transparent electrode 106*a*. In effective portion 1*a* of a substrate, the metallic electrode width "d" is the same as the conventional art. However, in non-effective portion 1*b* which does not affect transmittance of visual ray, an increased electrode width "d'" is provided. The range of the electrode width "d'" is greater than the electrode width "d" in effective portion 1*a* thereby implementing an easier contact of a checking probe 10 and is smaller than an electrode width "D" of a transparent electrode 106*a*.

In the thusly constituted structure, when performing the disconnection and short circuit checking operation of the metallic electrode 106*b* which has a minimum electrode width, the checking probe 100 is contacted with one end of the non-effective portion 1*b* of the metallic electrode 106*b* and a pad portion 1*c*, namely, the portion of B–B'.

Since the width of the pad portion 1*c*, namely, the metallic electrode 106*b* extended to the portion B is designed to be wider so that the checking probe 100 is easily contacted. In the present invention, the conventional structure is used.

In the present invention, one end B of the metallic electrode 106*b* has an increased electrode width "d'", so that the probe 100 is stably contacted. Therefore, alignment of an apparatus for checking disconnection or short circuit problem of the electrode is improved. The checking process is automated, and the checking time is decreased.

The discharge sustaining electrode according to another embodiment of the present invention is designed to increase the width "d'" of the electrode at both ends B—B of the non-effective portion 1*b* of the metallic electrode 106*b* as shown in FIG. 6.

In this structure, two checking probes 100 contact on both ends B—B of the metallic electrode 106*b*, so that the probe 100 is aligned on a horizontal straight line compared to the conventional art in which an alignment is made based on a certain step portion, whereby it is possible to improve an automation efficiency of the checking process.

Figure 1:
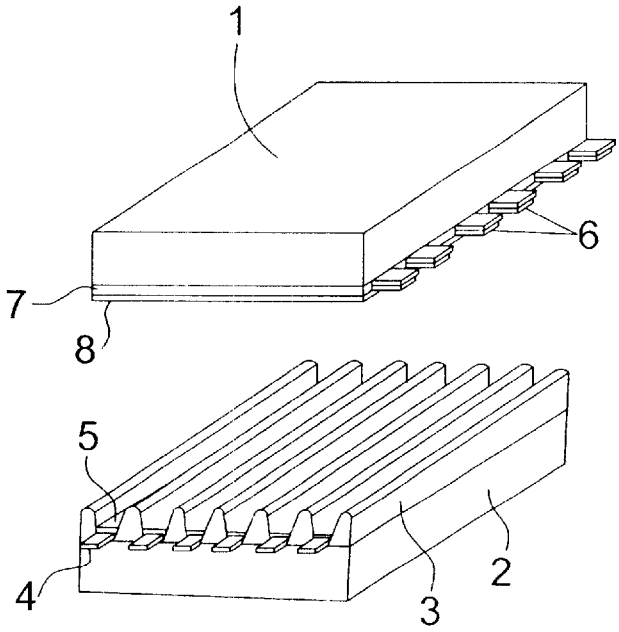
FIG. 1 PRIOR ART
FIG. 1 is a perspective view illustrating a panel of a conventional 3-electrode surface discharge type PDP.
Figure 2:
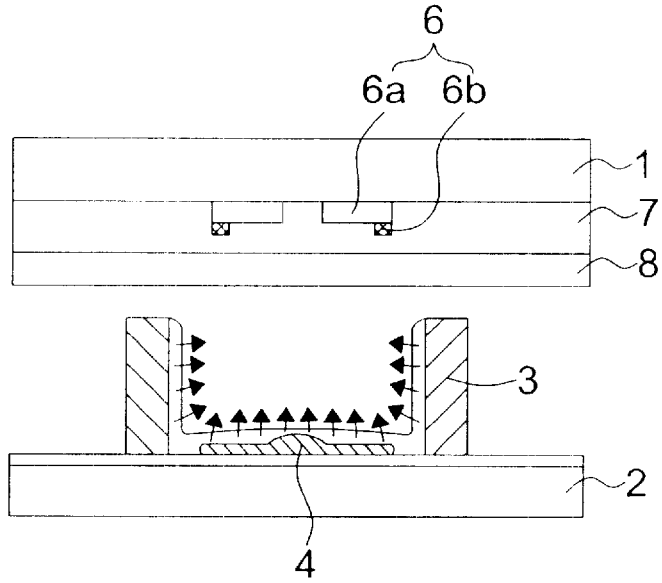
FIG. 2 PRIOR ART
FIG. 2 is a cross-sectional view illustrating a pixel of a panel in the conventional art.
Figure 3:
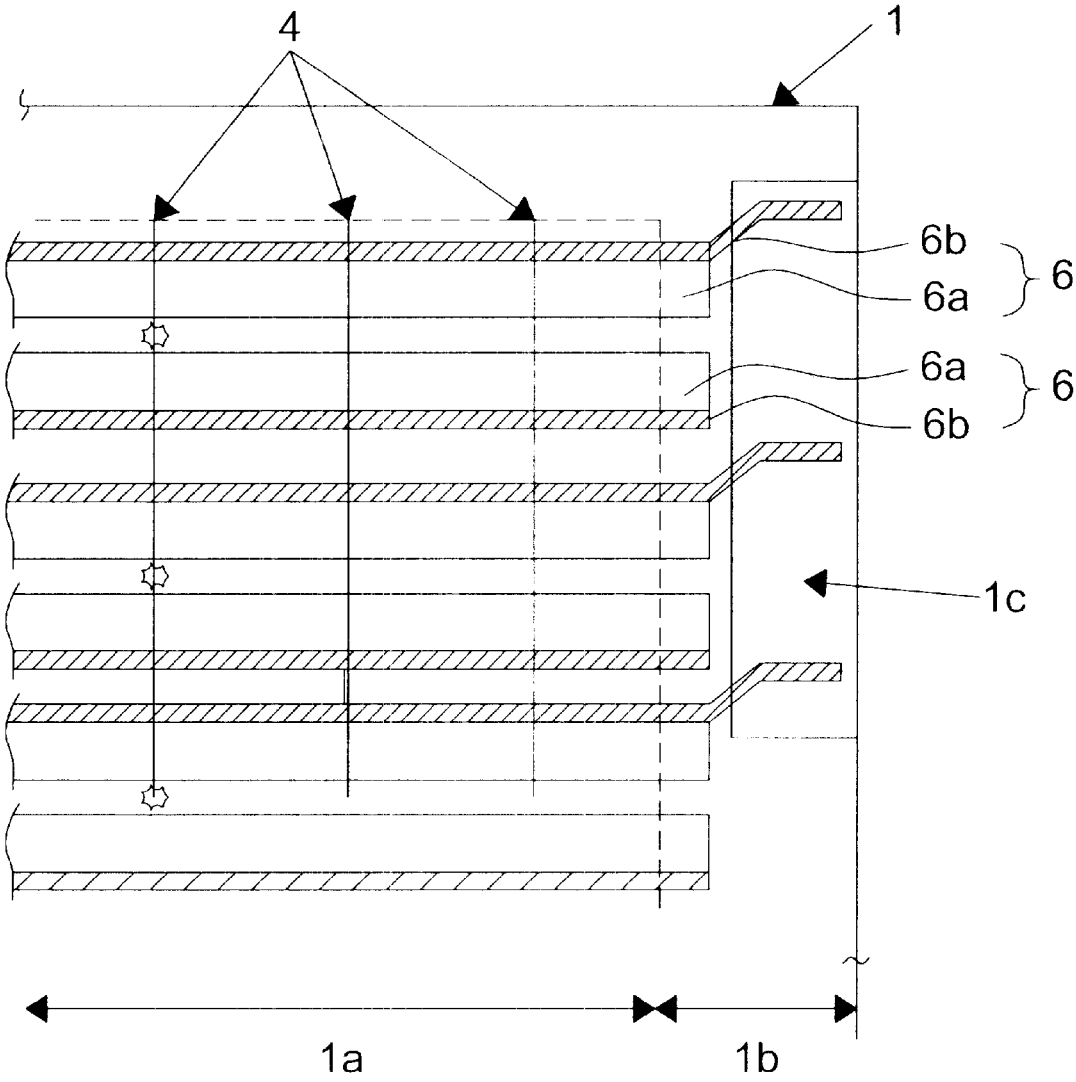
FIG. 3 PRIOR ART
FIG. 3 is a view illustrating a discharge electrode of a panel in the conventional art.
Figure 4:
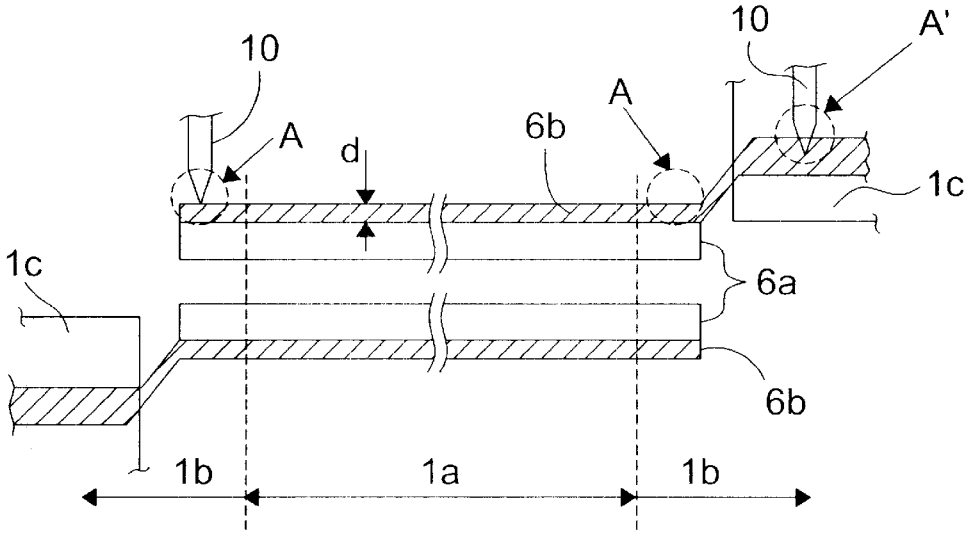
FIG. 4 PRIOR ART
FIG. 4 is a view illustrating a short circuit state of a discharge sustaining electrode in the conventional art.

Comparing with the conventional structure of the discharge sustaining electrode as shown in FIG. 4 and the structures of the discharge sustaining electrode as shown in FIGS. 5 and 6 according to the present invention, in the conventional art, in order to check a disconnection and short-circuit state of the metallic electrode, a person must check aligned state of all electrodes and checking probe with respect to all glass substrates. However, in the present invention, it is not necessary to check the aligned state of all electrodes of the glass substrates by increasing an align effective range of the metallic electrode and the probes without decreasing an aperture ratio of the effective surface by increasing the width of the metallic electrode contacting with the probe.

Therefore, the disconnection and short-circuit checking operations of the metallic electrodes are automatically performed since the probes are stably contacted on the both ends of the electrode.

As described above, the reliability of the products is increased based on the automated disconnection and short circuit checking operations of the electrodes, and it is possible to decrease the fabrication process of the PDP.

Although the preferred embodiment of the present invention have been disclosed for illustrative purposes, those skilled in the art will appreciate that various modifications, additions and substitutions are possible, without departing from the scope and spirit of the invention as recited in the accompanying claims.

What is claimed is:

1. In a PDP (Plasma Display Panel) which includes a substrate formed of a screen effective portion and a non-effective portion, and an electrode formed of a transparent electrode and a metallic electrode arranged in the screen effective portion of the substrate, each of said transparent electrode and metallic electrode having a predetermined width in the screen effective portion and having at least one end portion in the non-effective portion of the substrate, an improvement comprising:

said at least one end portion of the metallic electrode having a width in the non-effective portion greater than the predetermined width of the metallic electrode in the screen effective portion, wherein the width of the metallic electrode in the non-effective portion is the same as or smaller than a width of the transparent electrode, and wherein the at least one end portion of the metallic electrode does not extend into a pad portion of the substrate.

2. The electrode of claim 1, wherein the at least one end portion of the metallic electrode having a width greater than the predetermined width of the metallic electrode in the screen effective portion is an end of the metallic electrode opposite to an end that extends into a pad portion of the substrate.

3. The electrode of claim 1, wherein the metallic electrode has two end portions and a width of both end portions of said metallic electrode in the non-effective portion is greater than the predetermined width of the metallic electrode in the screen effective portion.

4. A PDP (Plasma Display Panel) comprising:

a substrate formed of a screen effective portion and a non-effective portion; and an electrode comprising:

a transparent electrode and a metallic electrode arranged in the screen effective portion of the substrate, each of said transparent electrode and metallic electrode having a predetermined width in the screen effective portion and having at least one end portion in the non-effective portion of the substrate, wherein the at least one end portion of the metallic electrode in the non-effective portion has a width greater than the predetermined width of the metallic electrode in the screen effective portion, wherein the width of the metallic electrode in the non-effective portion is the same as or smaller than a width of the transparent electrode, and wherein the at least one end portion of the metallic electrode does not extend into a pad portion of the substrate.

5. The electrode of claim 4, wherein the at least one end potion of the metallic electrode having a width greater than the predetermined width of the metallic electrode in the screen effective portion is an end of the metallic electrode opposite to an end that extends into a pad portion of the substrate.

6. The electrode of claim 4, wherein the metallic electrode has two end portions and a width of both end portions of said metallic electrode in the non-effective portion is greater than the predetermined width of the metallic electrode in the screen effective portion.

7. A PDP (Plasma Display Panel) comprising:

a substrate formed of a screen effective portion and a non-effective portion; and an electrode comprising:

a transparent electrode extending in the X direction and having a predetermined width in the Y direction in the screen effective portion;

a metallic electrode extending in the X direction and having a predetermined width in the Y direction in the screen effective portion, the metallic electrode having an edge extending in the X direction flush with an edge extending in the X direction of the transparent electrode and having at least one end portion in the non-effective portion of the substrate, wherein the at least one end portion of the metallic electrode in the non-effective portion has a width extending in the Y direction greater than the predetermined width of the metallic electrode in the screen effective portion, and wherein the at least one end portion of the metallic electrode does not extend into a pad portion of the substrate.

8. The electrode of claim 7, wherein the at least one end portion of the metallic electrode having a width greater than the predetermined width of the metallic electrode in the screen effective portion is an end of the metallic electrode opposite to an end that extends into a pad portion of the substrate.

9. The electrode of claim 7, wherein the metallic electrode has two end portions and a width of both end portions of said metallic electrode in the non-effective portion is greater than the predetermined width of the metallic electrode in the screen effective portion.

10. The electrode of claim 2 wherein the width of the metallic electrode in the non-effective portion is the same as or smaller than the predetermined width in the Y direction of the transparent electrode.

11. In a PDP (Plasma Display Panel) which includes a substrate formed of a screen effective portion and a non-effective portion, and an electrode formed of a transparent electrode and a metallic electrode arranged in the screen effective portion of the substrate, each of said transparent electrode and metallic electrode having a predetermined width in the screen effective portion and having at least one end portion in the non-effective portion of the substrate, an improvement comprising:

said at least one end portion of the metallic electrode having a width in the non-effective portion greater than the predetermined width of the metallic electrode in the screen effective portion, wherein the width of the metallic electrode in the non-effective portion is the same as or smaller than a width of the transparent electrode, and wherein the at least one end portion of the metallic electrode having a width greater than the predetermined width of the metallic electrode in the screen effective portion is an end of the metallic electrode opposite to an end that extends toward the pad portion of the substrate.

12. A PDP (Plasma Display Panel) comprising:

a substrate formed of a screen effective portion and a non-effective portion; and an electrode comprising:

a transparent electrode and a metallic electrode arranged in the screen effective portion of the substrate, each of said transparent electrode and metallic electrode having a predetermined width in the screen effective portion and having at least one end portion in the non-effective portion of the substrate, wherein the at least one end portion of the metallic electrode in the non-effective portion has a width greater than the predetermined width of the metallic electrode in the screen effective portion, wherein the width of the metallic electrode in the non-effective portion is the same as or smaller than a width of the transparent electrode, and wherein the at least one end portion of the metallic electrode having a width greater than the predetermined width of the metallic electrode in the screen effective portion is an end of the metallic electrode opposite to an end that extends toward the pad portion of the substrate.

13. A PDP (Plasma Display Panel) comprising:

a substrate formed of a screen effective portion and a non-effective portion; and an electrode comprising:

a transparent electrode extending in the X direction and having a predetermined width in the Y direction in the screen effective portion;

a metallic electrode extending in the X direction and having a predetermined width in the Y direction in the screen effective portion, the metallic electrode having an edge extending in the X direction flush with an edge extending in the X direction of the transparent electrode and having at least one end portion in the non-effective portion of the substrate, wherein the at least one end portion of the metallic electrode in the non-effective portion has a width extending in the Y direction greater than the predetermined width of the metallic electrode in the screen effective portion, and wherein the at least one end portion of the metallic electrode having a width greater than the predetermined width of the metallic electrode in the screen effective portion is an end of the metallic electrode opposite to an end that extends toward the pad portion of the substrate.

* * * * *